US007779888B2

(12) United States Patent
Messick, Jr. et al.

(10) Patent No.: US 7,779,888 B2
(45) Date of Patent: Aug. 24, 2010

(54) HANGER ASSEMBLY

(75) Inventors: George Howard Messick, Jr., E. New Market, MD (US); Charles Edward Hennigar, Hurlock, MD (US)

(73) Assignee: Cambridge International, Inc., Cambridge, MD (US)

( * ) Notice: Subject to any disclaimer, the term of this patent is extended or adjusted under 35 U.S.C. 154(b) by 353 days.

(21) Appl. No.: 11/235,086

(22) Filed: Sep. 27, 2005

(65) Prior Publication Data

US 2006/0075699 A1 Apr. 13, 2006

Related U.S. Application Data

(60) Provisional application No. 60/613,515, filed on Sep. 28, 2004.

(51) Int. Cl.
*A47H 1/00* (2006.01)
*E04B 5/00* (2006.01)

(52) U.S. Cl. ..... 160/330; 52/506.05

(58) Field of Classification Search ..... 160/327, 160/328, 330, 332, 349.1, 352, 354, 368.1; 248/214, 245, 223.41, 251, 288.11, 289.11, 248/299.1, 340; 211/87.01; 16/87.2
See application file for complete search history.

(56) References Cited

U.S. PATENT DOCUMENTS

| | | | | | |
|---|---|---|---|---|---|
| 562,380 | A | * | 6/1896 | Durphy | 248/265 |
| 902,635 | A | | 11/1908 | Wowra | |
| 1,465,938 | A | * | 8/1923 | Guider | 160/344 |
| 1,995,983 | A | | 3/1935 | Hesse | |
| 2,030,498 | A | | 2/1936 | Chmurski | |
| 2,136,042 | A | * | 11/1938 | Cornell et al. | 160/327 |
| 2,397,775 | A | * | 4/1946 | Burns | 160/390 |
| 2,605,828 | A | | 8/1952 | Lang | |
| 2,958,378 | A | | 11/1960 | Rubens | |
| 3,231,007 | A | | 1/1966 | Kerr | |
| 3,640,046 | A | | 2/1972 | Anderson et al. | |
| 3,798,856 | A | | 3/1974 | Gloskowski | |
| 4,083,156 | A | | 4/1978 | Tye | |
| 4,736,608 | A | | 4/1988 | Laws et al. | |
| 4,800,947 | A | * | 1/1989 | Loomis | 160/368.1 |
| 5,058,846 | A | | 10/1991 | Close | |
| 5,915,449 | A | | 6/1999 | Schwartz | |

(Continued)

FOREIGN PATENT DOCUMENTS

WO WO 03/018274 A1 3/2003

*Primary Examiner*—Katherine W Mitchell
*Assistant Examiner*—Jeremy C Ramsey
(74) *Attorney, Agent, or Firm*—Buchanan Ingersoll & Rooney PC

(57) ABSTRACT

A architectural mesh hanging system includes an architectural mesh panel having a predetermined width, a first support member having a predetermined length substantially equal to the predetermined width of the architectural mesh panel, and a second support member having a predetermined length substantially equal to the predetermined width of the architectural mesh panel. At least two upper hanger assemblies support the first support member and are attachable to a support surface for hanging the architectural mesh panel. At least two lower hanger assemblies support the second support member and are attachable to the support surface for hanging the architectural mesh panel. The architectural mesh panel is disposed at least partially about the first support member and the second support member such that, when hanging, the first and second support members are substantially obscured from view by the architectural mesh panel.

9 Claims, 13 Drawing Sheets

U.S. PATENT DOCUMENTS

| | | | | |
|---|---|---|---|---|
| 6,176,050 | B1 | 1/2001 | Gower | |
| 6,269,958 | B1 | 8/2001 | Pollock et al. | |
| 6,378,820 | B1 | 4/2002 | Mooney et al. | |
| 6,412,540 | B2 | 7/2002 | Hendee | |
| 6,793,360 | B2 | 9/2004 | Goslee | |
| 6,865,852 | B2 | 3/2005 | Gower | |
| 6,886,299 | B2 | 5/2005 | Gower | |
| 6,886,701 | B2 | 5/2005 | Hong et al. | |
| 2002/0000301 | A1 | 1/2002 | Rolin | |
| 2003/0131543 | A1 | 7/2003 | Hansort | |
| 2004/0099780 | A1 * | 5/2004 | McGee | 248/289.11 |
| 2005/0269466 | A1 | 12/2005 | Conway et al. | |

* cited by examiner

HANGER ASSEMBLY

CROSS-REFERENCE TO RELATED APPLICATIONS

The present application claims priority to provisional application U.S. Ser. No. 60/613,515, filed Sep. 28, 2004, the entire contents of which are hereby incorporated by reference.

TECHNICAL FIELD

The present invention is directed to an apparatus for securing architectural mesh and, more particularly, to a hanger system for the vertical or horizontal installation of architectural mesh and the like.

BACKGROUND OF THE INVENTION

Architectural metallic meshes are generally used in commercial and business environments to provide elegant wall panels, doors and other surfaces whenever an aesthetic appearance of polish and prestige are of primary importance. Architectural mesh is also an excellent choice for high contact areas, such as the interior walls of elevator cabs, escalator walls, and sales and reception areas, because it is generally scratch, dent and corrosion resistant. As such, architectural metallic mesh maintains a stunning appearance with minimal maintenance.

Woven into panels from brass, stainless steel, copper, and/or other desired metals or alloys, architectural mesh offers a richness of texture, pattern and color that cannot be duplicated by any other material. Architectural mesh can also be polished, finished and combined with different background colors to create a custom look and configuration.

Depending upon the chosen weave, the interstices or apertures between the weft or fill wires and the warp wires may allow light to pass through the architectural mesh. Alternatively, if the weave is tight and the wires are more closely adjacent to one another, the passage of light through the mesh will be selectively prevented. Accordingly, as the requirement for incorporating energy savings into building design increases, and hence the need for architecturally acceptable sun shading or screening, architectural mesh offers a variety of options that can meet the shading needs while still maintaining architectural requirements.

Thus, it would be desirable to provide system for reliably and conveniently applying an architectural mesh product to a building wall, so as to create the desired sun shading without detracting from the aesthetic appearance of the wall.

BRIEF DESCRIPTION OF THE DRAWINGS

These and other objects, features, and advantages of the present invention will become more readily apparent to those skilled in the art upon reading the following detailed description, in conjunction with the appended drawings in which.

DETAILED DESCRIPTION OF THE PREFERRED EMBODIMENT

Figure 1:
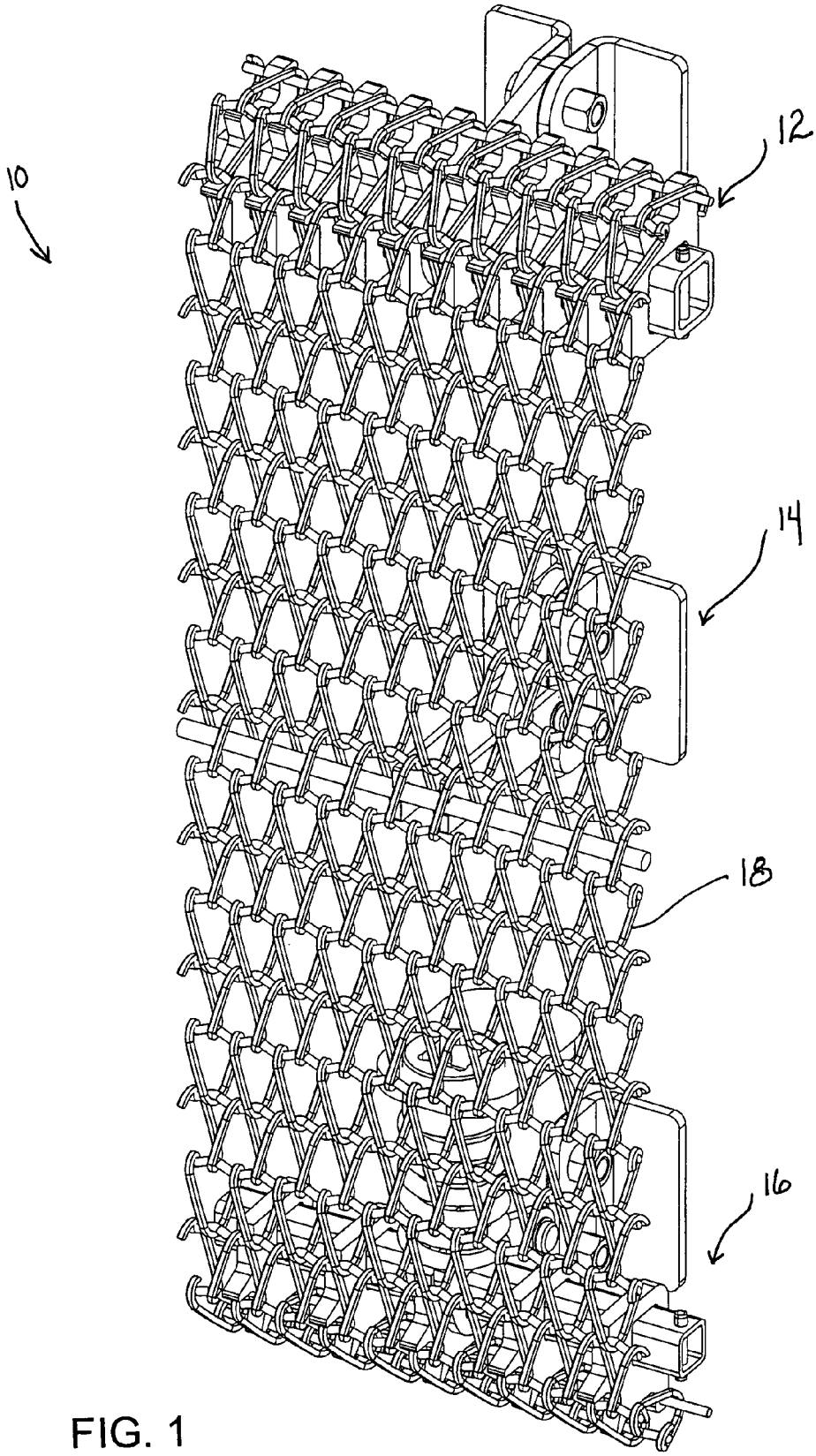
FIG. 1 is a perspective view of the hanger system of the present invention.
Figure 2:
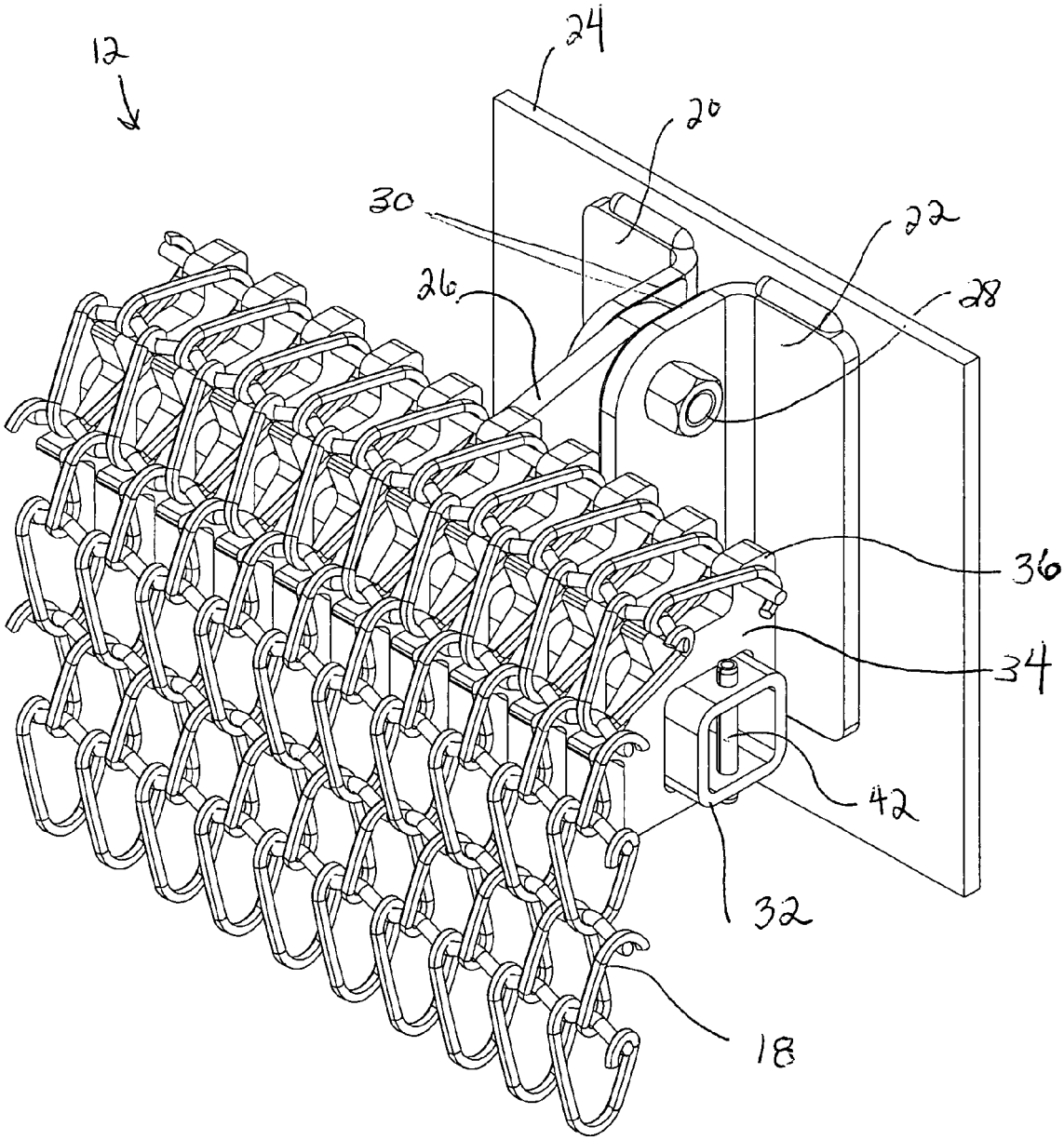
FIG. 2 is a perspective view of a first hanger assembly of the hanger system of the present invention.

The hanger system of the present invention is designated generally by reference numeral 10, as shown in FIG. 1. Hanger system 10 includes a first hanger assembly 12, an intermediate hanger assembly 14, and a second hanger assembly 16. Although only a single hanger system 10 is illustrated in the drawings, it will be understood by one skilled in the art that depending upon the width of the panel of architectural mesh, a plurality of such hanger systems will be disposed at predetermined intervals along said panel.

Referring also to FIGS. 2-5, first hanger assembly 12 is preferably disposed at an upper vertical edge of a section of architectural mesh 18 or a similar metal configuration. The first hanger assembly 12 includes a left wall bracket 20 and a right wall bracket 22 preferably attached to a vertical support surface 24 disposed parallel to the desired hanging plane of the architectural mesh sunscreen 18. A tube hanger bracket 26 is disposed between the left and right wall brackets 20, 22 and secured by a plurality of fasteners 28 extending therethrough. A hanger shim 30 may preferably be disposed between each side of the tube hanger bracket 26 and the inner surface of each wall bracket 20, 22.

Figure 3:
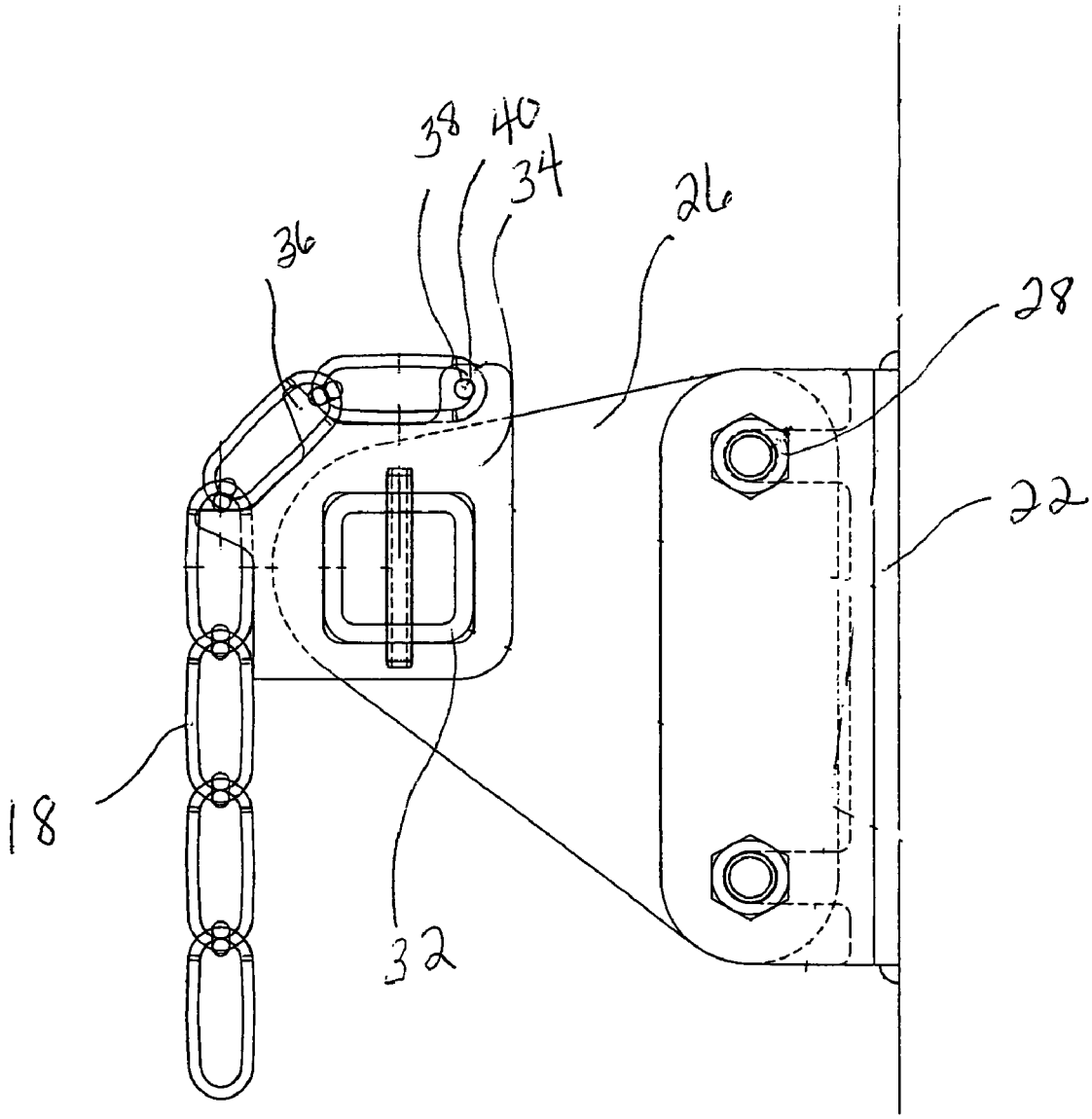
FIG. 3 is a side elevational view of the first hanger assembly.
Figure 4:
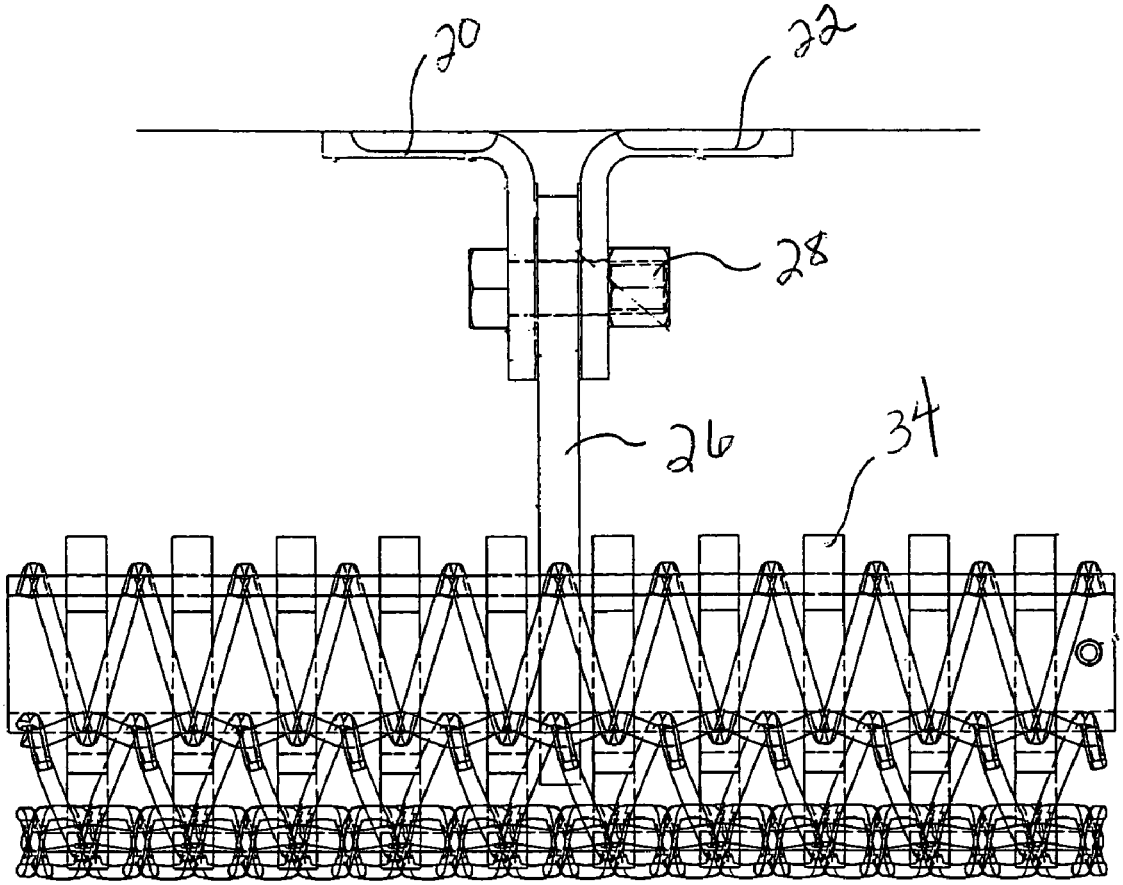
FIG. 4 is a top plan view of the first hanger assembly.
Figure 5:
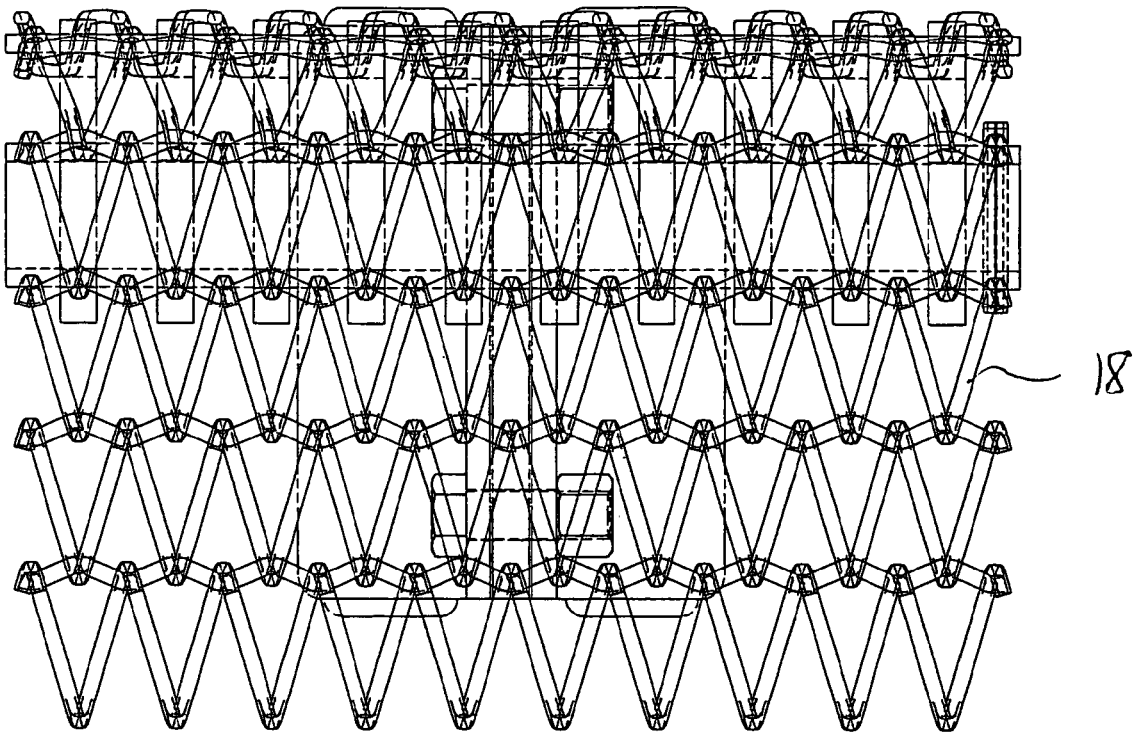
FIG. 5 is a front elevational view of the first hanger assembly.
Figure 6:
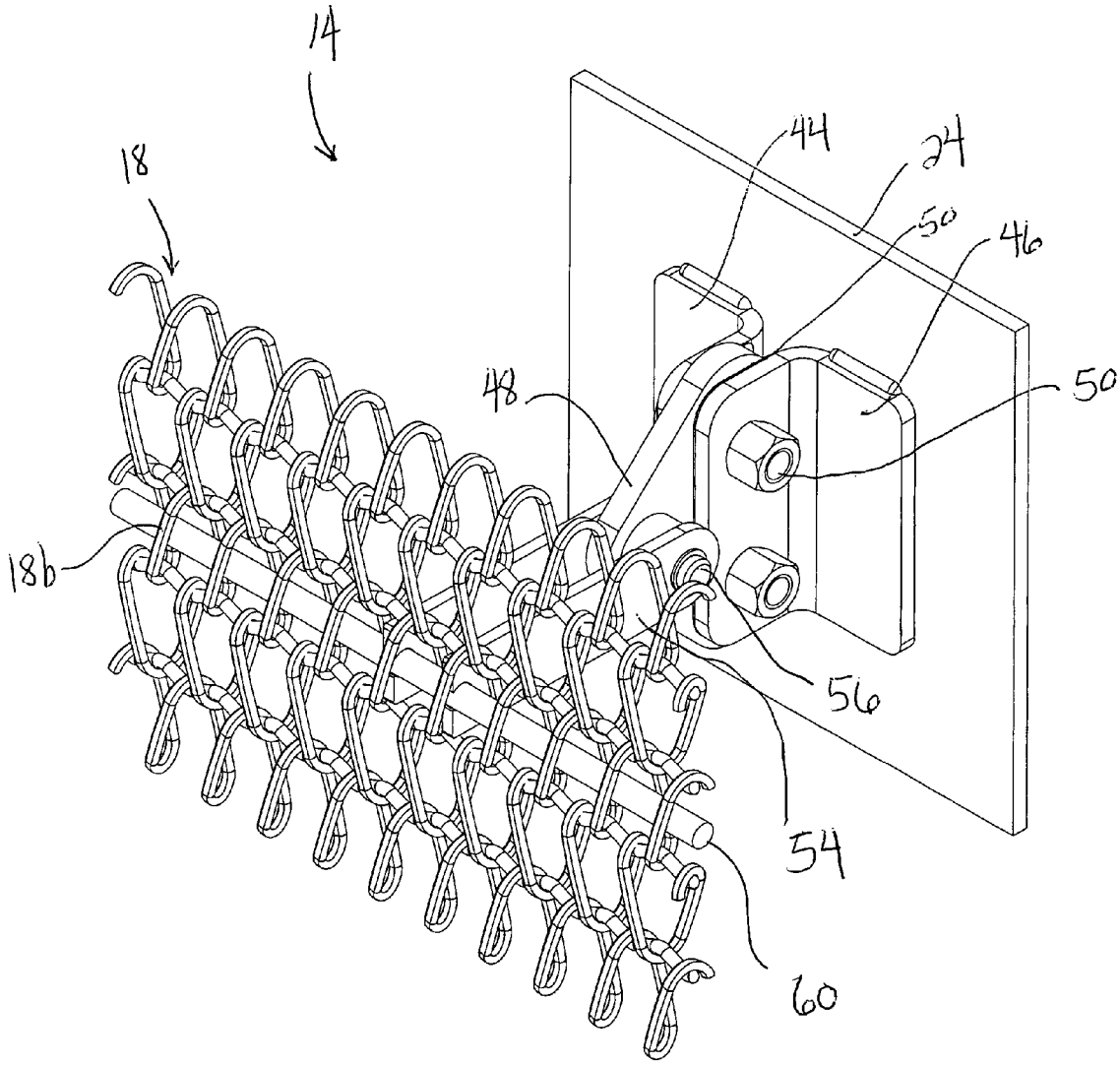
FIG. 6 is a perspective view of an intermediate hanger assembly of the hanger system of the present invention.

A plurality of tube hanger brackets 26 support a tube 32, preferably a rectangular box tube, having a predetermined length suitable for the width of the architectural mesh panel 18. Each of the tube hanger brackets 26 preferably includes an opening for receiving the tube 32 therethrough, as best shown in FIG. 3. A plurality of hanger plates 34 are disposed about the periphery of the box tube 32, each hanger plate 34 having a plurality of sprocket teeth 36 extending from a surface thereof so as to engage the architectural mesh and an opening therein for receiving the tube 32 therethrough. In the preferred embodiment, the mesh 18 is wrapped from the upper surface of the hanger plate 34 around the plurality of plate sprocket teeth 36 and then extends vertically down. At the upper surface of the hanger plate 34, an opening 38 is provided for receiving a retainer rod 40. Thus, the retainer rod 40 extends through each hanger plate 34 and engages a loop 18*a* of the mesh 18 forming the architectural panel. A retainer pin 42 disposed on each terminal end of the box tube 32 further secures the mesh 18 against horizontal movement. Moreover, because the mesh material is wrapped around the hanger plate 34 and the box tube 32, these supporting elements are substantially hidden from view when the architectural panel 18 is installed in the desired application; thus not detracting from the aesthetic appeal of the architectural panel 18.

As illustrated in FIG. 3, the centerline of the box tube 32 is disposed a distance "a" from the support surface 24 to which the wall brackets 20, 22 are attached and the vertical centerline of the mesh 18 forming the architectural panel is disposed a distance "b" from the support surface 24. In a preferred embodiment, distance "a" is approximately 5.0 inches and distance "b" is approximately 6.8 inches, however, these distances may be varied depending upon the particular conditions of the installation.

Referring also to FIGS. 6-9, intermediate hanger assembly 14 is preferably disposed at a middle or intermediate vertical location on a section of architectural mesh 18 or a similar metal configuration. The intermediate hanger assembly 14 includes a left wall bracket 44 and a right wall bracket 46 preferably attached to the vertical support surface 24 disposed parallel to the desired hanging plane of the architectural mesh sunscreen 18. An intermediate plate 48 is disposed between the left and right wall brackets 44, 46 and secured by a plurality of fasteners 50 extending therethrough. A wall bracket shim 52 may preferably be disposed between each side of the intermediate plate 48 and the inner surface of each wall bracket.

Each intermediate plate 48 supports an intermediate link 54 by way of a pivot pin connection 56. At the forward edge of the intermediate link 54, an opening 58 is provided for receiving a retainer rod 60. Thus, the retainer rod 60 extends through each intermediate link 54 and engages a loop 18*b* of the mesh 18 forming the architectural panel. Moreover, because the mesh material is disposed in front of the intermediate hanger assembly 14 and the retainer rod 60, these supporting elements are substantially hidden from view when the architectural panel is installed in the desired application; thus not detracting from the aesthetic appeal of the architectural panel 18.

Figure 7:
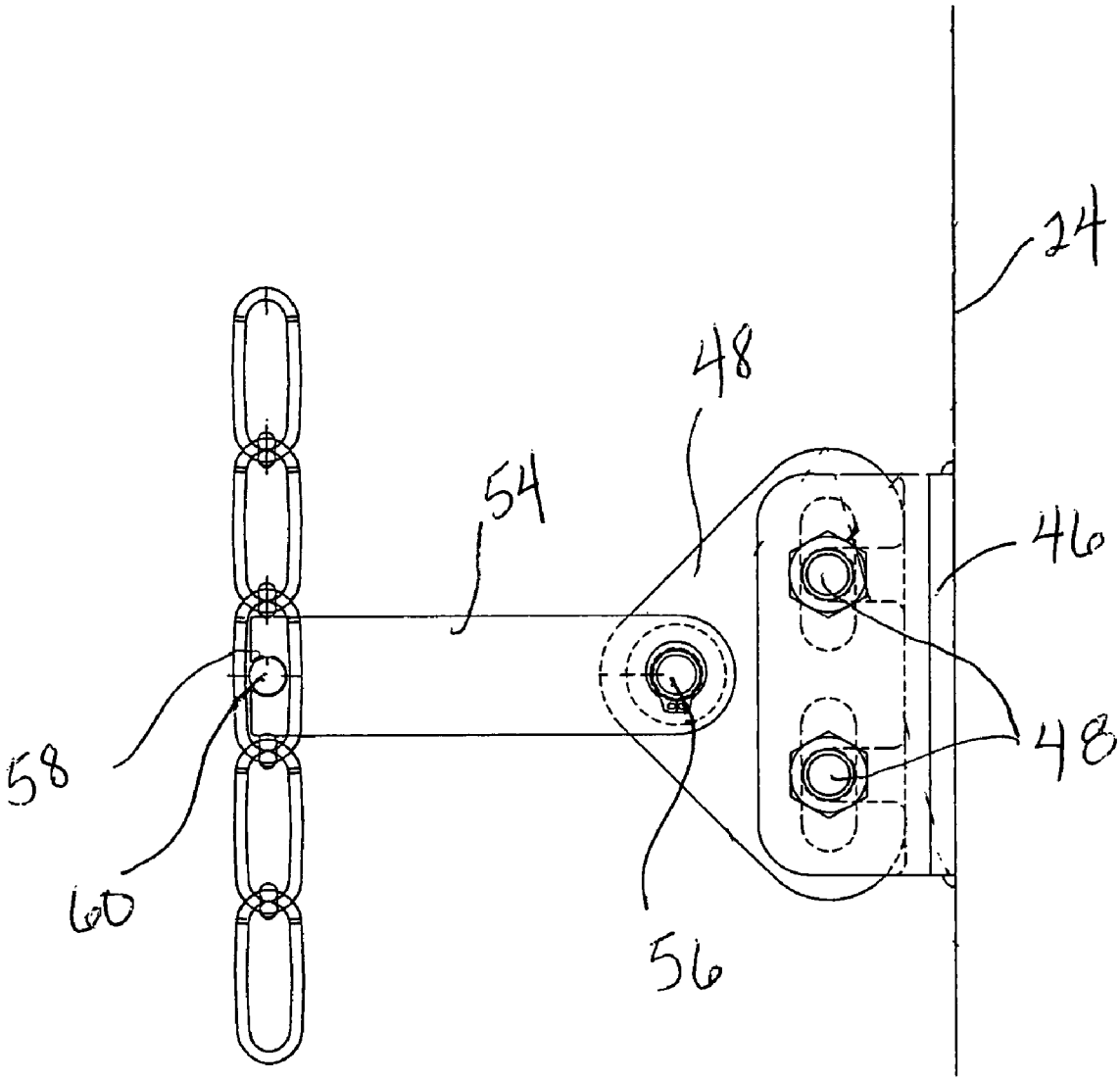
FIG. 7 is a side elevational view of the intermediate hanger assembly.
Figure 8:
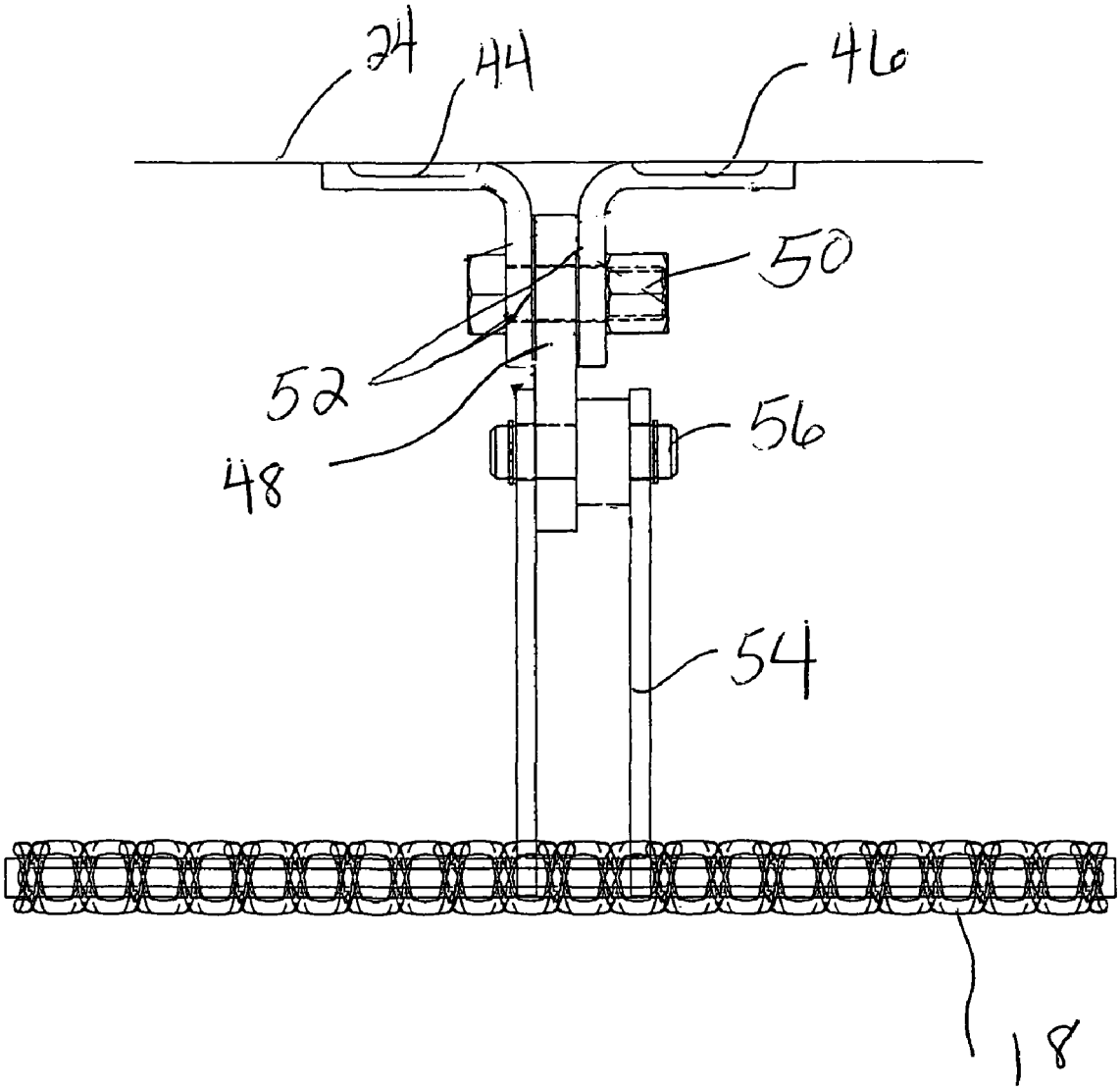
FIG. 8 is a top plan view of the intermediate hanger assembly.
Figure 9:
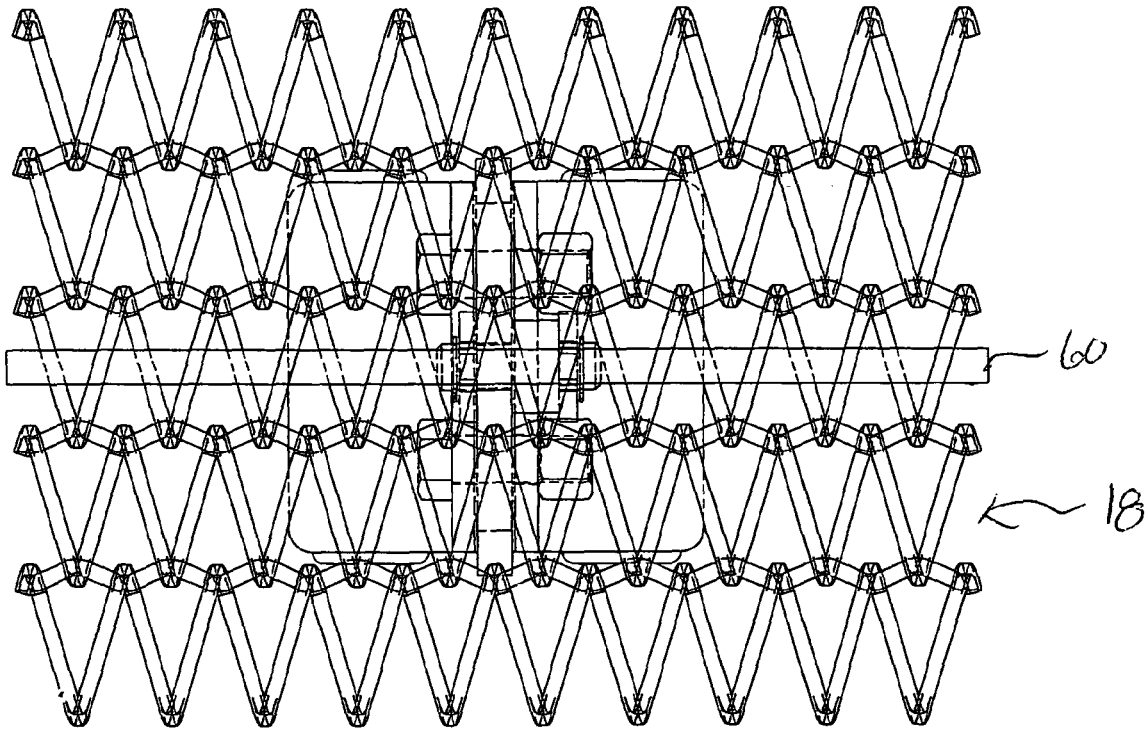
FIG. 9 is a front elevational view of the intermediate hanger assembly.
Figure 10:
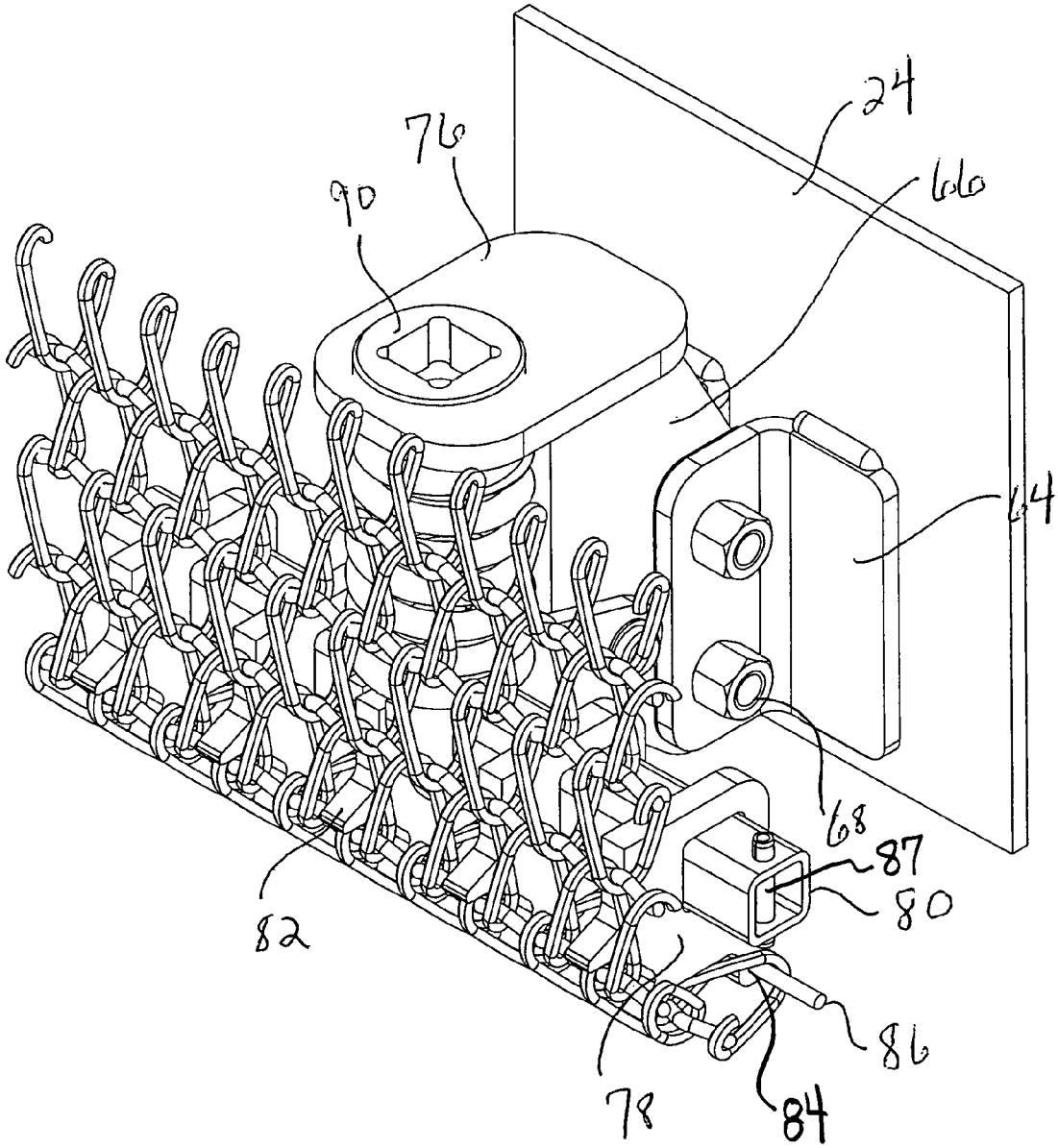
FIG. 10 is a perspective view of a second hanger assembly of the hanger system of the present invention.

As illustrated in FIG. 7, the centerline of the retainer rod 60 attached to the mesh 18 forming the architectural panel is disposed a distance "b" from the support surface 24. In a preferred embodiment, distance "b" is approximately 6.8 inches; however, this distance may be varied depending upon the particular conditions of the installation.

Referring also to FIGS. 10-13, second hanger assembly 16 is preferably disposed at a lower vertical edge of a section of architectural mesh 18 or a similar metal configuration. The second hanger assembly 16 includes a left wall bracket 62 and a right wall bracket 64 preferably attached to the vertical support surface 24 disposed parallel to the desired hanging plane of the architectural mesh sunscreen 18. A tension plate 66 is disposed between the left and right wall brackets 62, 64 and secured by a plurality of fasteners 68 extending therethrough. A hanger shim 70 may preferably be disposed between each side of the tension plate 66 and the inner surface of each wall bracket 62, 64.

In a preferred embodiment, each tension plate 66 is connected by way of a pivot pin 72 to a tension arm member 74 disposed at a lower end thereof, and to a spring cap 76 at an upper end thereof. The tension arm member 74 is connected to hanger plate 78, which as described above for the first hanger assembly 12, also support a tube 80, preferably a rectangular box tube, having a predetermined length suitable for the width of the architectural mesh panel 18. A plurality of hanger plates 78 are disposed about the periphery of the box tube 80, each hanger plate 78 having a plurality of sprocket teeth 82 extending from a surface thereof so as to engage the architectural mesh 18. In the preferred embodiment, the mesh 18 is wrapped from the lower surface of the hanger plate 78 around the plurality of plate teeth 82 and then extends vertically upward toward the intermediate hanger assembly 14. At the lower surface of the hanger plate 78, an opening 84 is provided for receiving a retainer rod 86. Thus, the retainer rod 86 extends through each hanger plate 78 and engages a loop 18*c* of the mesh 18 forming the architectural panel. A retainer pin 87 disposed on each terminal end of the box tube 80 further secures the mesh 18 against horizontal movement. Moreover, because the mesh 18 material is wrapped around the hanger plate 78 and the box tube 80, these supporting elements are substantially hidden from view when the architectural panel 18 is installed in the desired application; thus not detracting from the aesthetic appeal of the architectural panel.

Figure 11:
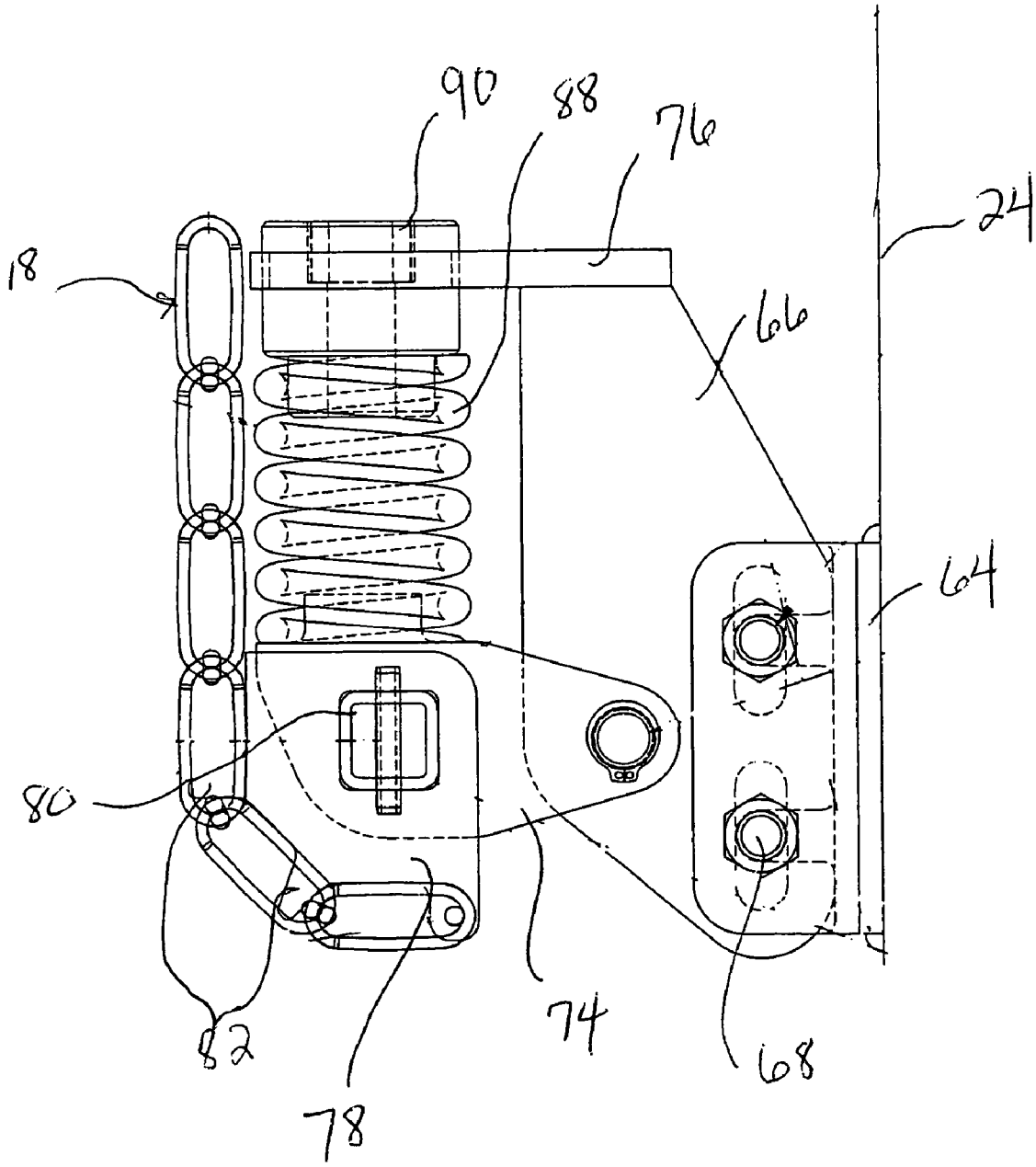
FIG. 11 is a side elevational view of the second hanger assembly.
Figure 12:
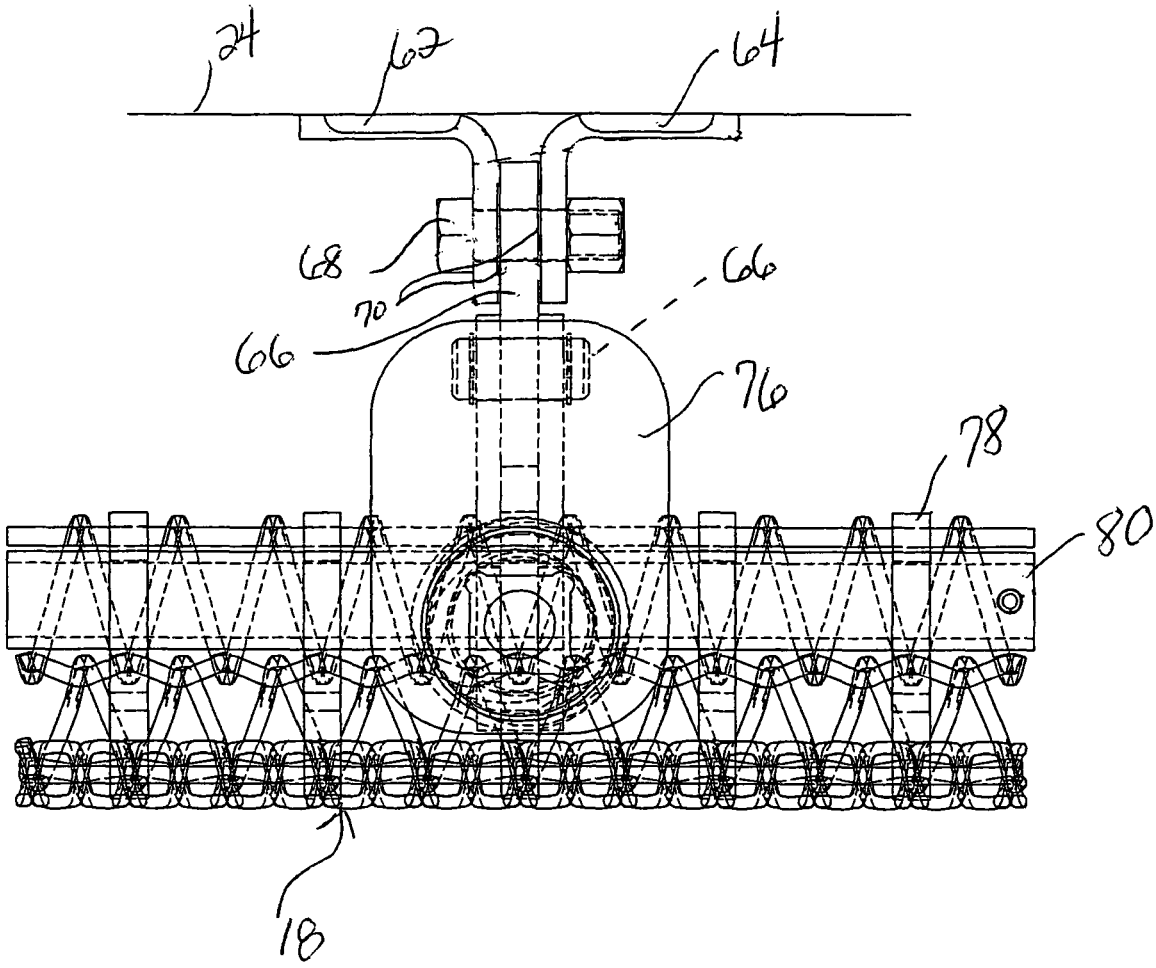
FIG. 12 is a top plan view of the second hanger assembly.
Figure 13:
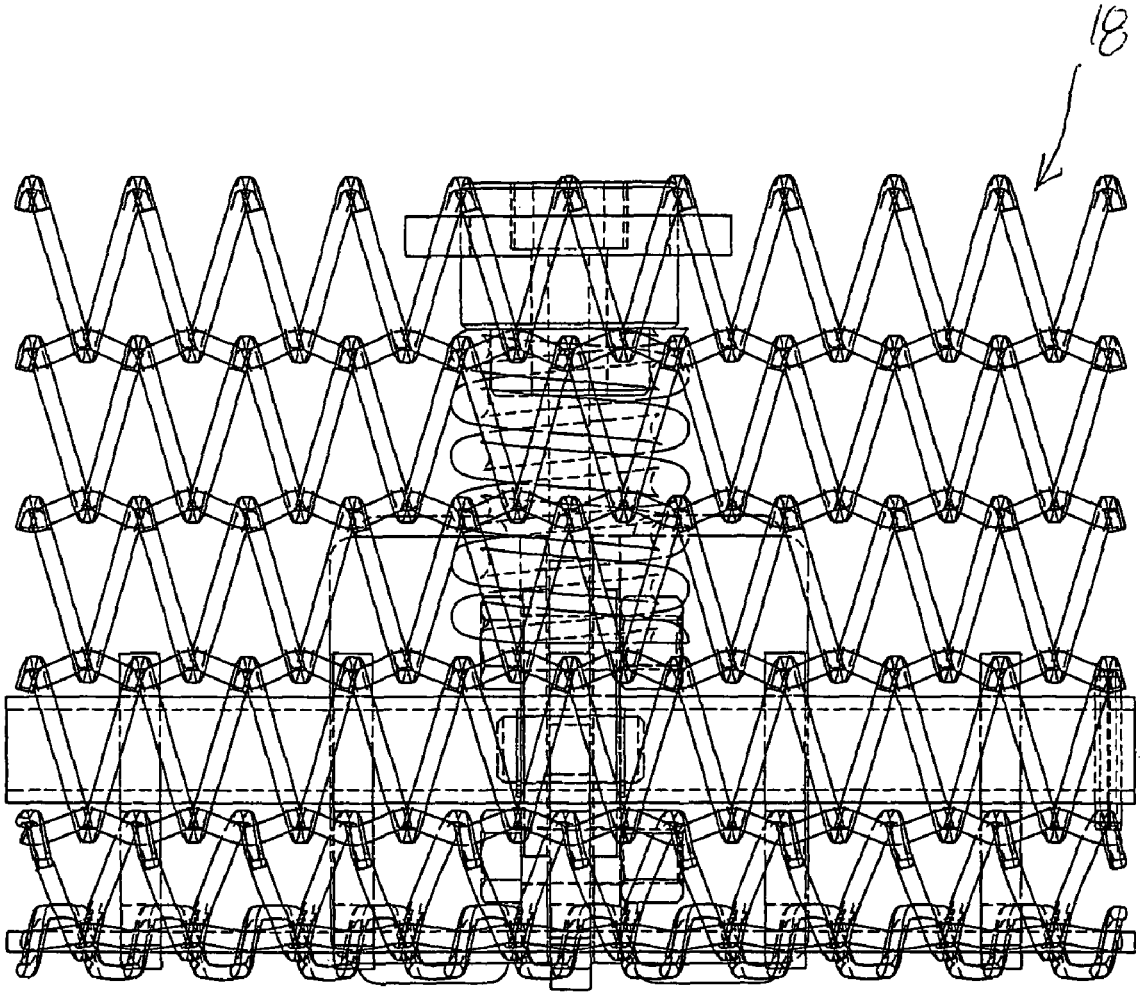
FIG. 13 is a front elevational view of the second hanger assembly.

As illustrated in FIG. 11, the centerline of the box tube 80 is aligned with a spring 88 extending between the tension arm member 74 on the bottom and the spring cap 76 on the top. A spring pilot 90 extends through the spring cap 76 and is secured to the spring 88. The spring 88 in the second hanger assembly 16 is held in compression such that any force applied to the mesh 18 encounters a reactive force from the spring 88. Depending upon wind conditions and other factors, a tension assembly such as second hanger assembly 16 may not be required on the lower edge of the hanger system 10. In such instances, a hanger assembly similar to first hanger assembly 12 may also be utilized on the lower edge of the mesh.

While the present invention has been described with respect to a particular embodiment of the present invention, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the claims.

We claim:

1. A hanger apparatus for hanging an architectural mesh panel, said hanger apparatus comprising:

a first tube for supporting a first edge of the architectural mesh panel;

a second tube for supporting a second edge of the architectural mesh panel;

at least one first hanger assembly for attachment to a support surface, said at least one first hanger assembly supporting at least a portion of said first tube;

at least one second hanger assembly for attachment to a support surface, said at least one second hanger assembly supporting at least a portion of said second tube;

wherein said first and second tubes include a plurality of hanger plates, said hanger plates having a opening therein for receiving one of said respective tubes therethrough, said openings in said hanger plates defining a cross sectional area substantially corresponding to a cross section of said first tube and/or said second tube, and wherein each said hanger plate is disposed about an exterior periphery of said respective tube, each said hanger plate including a first surface having a plurality of protrusions extending radially perpendicular relative to a transverse axis of one of said respective tubes, a second surface having a plurality of protrusions extending radially perpendicular relative to a longitudinal axis of one of said respective tubes, a third substantially planar surface opposing said first surface, and a fourth substantially planar surface opposing said second surface and disposed substantially perpendicular to said third surface, said plurality of protrusions on said first and second surfaces dimensioned for engaging openings in said architectural mesh panel, said hanger plates being configured such that, when the architectural mesh panel is hanging, said tubes and said hanger plates are substantially obscured from view by the architectural mesh panel.

2. The hanger apparatus according to claim 1, wherein said at least one first hanger assembly comprises first and second wall brackets attachable to the support surface.

3. The hanger apparatus according to claim 2, wherein said at least one first hanger assembly comprises a hanger bracket disposed between the first and second wall brackets, said hanger bracket being secured to said first tube.

4. The hanger apparatus according to claim 1, wherein said at least one second hanger assembly comprises first and second wall brackets attachable to the support surface.

5. The hanger apparatus according to claim 4, wherein said at least one second hanger assembly further comprises a tension plate disposed between the first and second wall brackets.

6. The hanger apparatus according to claim 5, wherein an upper surface of said tension plate is connected to a spring cap, and a lower surface of said tension plate is connected by way of a pivot pin to a tension arm member, said tension arm member being secured to said second tube.

7. The hanger apparatus according to claim 6, wherein said at least one second hanger assembly further comprises a spring extending between said spring cap and said tension arm member.

8. The hanger apparatus of claim 1, wherein said at least one first hanger assembly comprises an upper hanger assembly for supporting an upper edge of the architectural mesh panel, said at least one second hanger assembly comprises a lower hanger assembly for supporting a lower edge of the architectural mesh panel, and further comprising an intermediate hanger assembly, said intermediate hanger assembly comprising a first wall bracket, a second wall bracket, and an intermediate plate disposed therebetween, said intermediate plate supporting an intermediate link for engaging the architectural mesh panel.

9. The hanger apparatus according to claim 3, wherein said hanger bracket includes an opening for receiving said first tube therethrough.

* * * * *